US007251865B2

(12) United States Patent
Takamura et al.

(10) Patent No.: US 7,251,865 B2
(45) Date of Patent: Aug. 7, 2007

(54) BUTTON

(75) Inventors: Yoshio Takamura, Kurobe (JP); Daisuke Hayashi, Meerbusch (DE)

(73) Assignee: YKK Corporation, Tokyo (JP)

( * ) Notice: Subject to any disclaimer, the term of this patent is extended or adjusted under 35 U.S.C. 154(b) by 77 days.

(21) Appl. No.: 10/523,317

(22) PCT Filed: Jul. 29, 2003

(86) PCT No.: PCT/JP03/09584

§ 371 (c)(1),
(2), (4) Date: Feb. 1, 2005

(87) PCT Pub. No.: WO2004/012550

PCT Pub. Date: Feb. 12, 2004

(65) Prior Publication Data

US 2006/0162133 A1 Jul. 27, 2006

(30) Foreign Application Priority Data

Aug. 1, 2002 (JP) ..... 2002-224610

(51) Int. Cl.
*A44B 1/28* (2006.01)

(52) U.S. Cl. ..... 24/114.4; 24/113 MP; 24/691

(58) Field of Classification Search ..... 24/691, 24/696, 103, 114.4, 114.05, 108, 113 R, 113 MP, 24/94, 95
See application file for complete search history.

(56) References Cited

U.S. PATENT DOCUMENTS 4,387,488 A * 6/1983 Kanzaka ..... 24/113 R
4,662,033 A 5/1987 Wieland, Jr. et al.
5,575,043 A * 11/1996 Candotti ..... 24/114.4

FOREIGN PATENT DOCUMENTS

JP 54-151504 10/1979
JP 2000-106914 4/2000

* cited by examiner

*Primary Examiner*—James R. Brittain
(74) *Attorney, Agent, or Firm*—Everest Intellectual Property Law Group; Michael S. Leonard

(57) ABSTRACT

The present invention provides a button including a button body 10 and a fixture 40 for fixing the button body to fabric. The button body 10 includes a shell member 11 constituting a button outer shell and an accommodation member 31. The shell member 11 includes a button cover 22 and a neck 14 formed cylindrically on the back side of the button cover 22 and having an opening 17 at an outer edge thereof. The accommodation member 31 has a shaft 33 accommodated in the neck with a portion thereof protruding from the opening, and an insert hole 34 formed on the protruding end face of the shaft for the fixture to be inserted therein. Crimping parts 18 are formed on one of the inner periphery of the opening or on the outer peripheral surface of the shaft at specified positions with a prespecified space therebetween along the circumferential direction so as to crimp into the other.

7 Claims, 9 Drawing Sheets

BUTTON

TECHNICAL FIELD

The present invention relates to a button used, for instance, in jeans. More specifically this invention relates to a button including a button body and a fixture for holding fabric such as a garment from the opposite side to the button body for fixing the button body to the fabric.

BACKGROUND ART

As a button used for a garment such as jeans, there has been known a button including a button body and a fixture for holding fabric such as a garment from the opposite side to the button body for fixing the button body to the fabric.

For instance, U.S. Pat. No. 5,575,043 discloses a button for jeans. This button includes a button body having a button covering member and an accommodation member incorporated inside this button covering member and a fixture for holding fabric such as a garment from the opposite side to the button body for fixing the button body to the fabric.

The button covering member includes a front side covering material formed by spinning metal and a back side covering member also formed by spinning metal. The back side covering member includes a cylindrical neck, a flange formed at an edge of the neck and having an outer diameter larger than that of the neck, and an opening formed at another edge of the neck. An outer periphery f the front side covering member is engaged with an outer periphery of the flange to form a button having a disk-like form.

The accommodation member is made of synthetic resin and includes a collar accommodated in the button and a shaft accommodated in the neck. Another end of the shaft protrudes from the opening, and an insert hole for a fixture to be inserted therein is formed at a center of the protruding end face.

When the fixture is inserted into the insert hole of the accommodation member from the opposite side to the button body and through the fabric, an outer periphery of the shaft is expanded outward and contacts an inner periphery of the opening, so that the accommodation member and the button covering member are integrated with each other and the button body is fixed to the fabric.

With the structure described above, however, the accommodation member and the button covering member are not sufficiently integrated with each other.

As a form of a tip of the shaft, namely a form of a cross section near the protruding end part protruding from the opening is formed by beveling corners of the square with R-curved surfaces, and even when the fixture is inserted into the insert hole of the accommodation member, an outer periphery of the shaft only contacts the inner periphery of the opening, and sometimes the button covering member may rotate relative to the accommodation member.

Generally, some decorations such as a character or a logo are provided on a surface of a button used in jeans or the like, namely on a front side covering material of the button covering member, and when the phenomenon as described above occurs, the character or the like becomes harder to be recognized with the beauty lost, which is not preferable from the designing point of view.

For solving the troubles as described above, an object of the present invention is to provide a button capable of ensuring tight integration of a shell member constituting a covering shell of a button and an accommodation member incorporated in the shell member for preventing relative rotation of the two members without fail.

DISCLOSURE OF THE INVENTION

The button according to the present invention includes a button body and a fixture for fixing the button body to a fabric from the opposite side to the button body with the fabric therebetween, in which: the button body has a shell member constituting an outer shell for the button and an accommodation member accommodated in the shell member; the shell member includes a button top covering part and a cylindrical neck provided on the back side of the button cover and having an opening at an outer edge thereof; the accommodation member includes a shaft accommodated in the neck with a part thereof protruding from the opening and an insert hole formed on the protruding end face of the shaft for the fixture to be inserted therein and is formed with a material softer at least as compared to that used for forming the neck with the outer periphery thereof capable of expanding outward from the inner periphery of the opening when the fixture is inserted into the insert hole; and crimping parts formed on one of the inner periphery of the opening or the outer peripheral surface of the shaft with a prespecified space in the circumferential direction thereof so as to crimp into or be crimped by the other.

The expression that the crimping parts are formed with a prespecified space in the circumferential direction as used herein includes the case in which a plurality of crimping or fetched parts are provided in the circumferential direction each with a step in the axial direction of the shaft.

With the configuration as described above, when a button is fixed on fabric, by inserting the fixture through the fabric into the insert hole of the accommodation member from the opposite side to the button body with the fabric therebetween, the shaft of the accommodation member is expanded outward to an outer position than the inner contour of the opening.

As the crimping parts for are formed on one of the inner periphery of the opening or the outer peripheral surface of the shaft with a prespecified space in the circumferential direction thereof so as to crimp into or be crimped by the other, the shell member and the accommodation member can be integrated with each other by the crimping parts. In other words, relative rotation of the shell member against the accommodation member can be prevented without fail.

In addition, as the crimping parts are formed with a prespecified space therebetween in the circumferential direction, the crimping parts uniformly crimp into the entire periphery of the shaft, so that the shell member and the accommodation member can be integrated with each other more tightly (uniform crimping effect).

In the button according to the present invention, the crimping parts are preferably a plurality of protrusions formed with a prespecified space along an internal periphery of the opening.

The shaft preferably has a round cross section substantially perpendicular to the center line thereof.

With the configuration as described above, when the shaft of the accommodation member is expanded outward in association with insertion of the fixture (into an insert hole of the accommodation member), the protrusions formed on the inner periphery of the opening crimp into an outer peripheral surface of the shaft, so that the shell member and the accommodation member are tightly integrated with each other. In addition, as the protrusions are formed along the inner periphery of the opening, when the opening is formed by punching in the press machining or the like, also the protrusions can be formed simultaneously. Therefore, the button according to the present invention can be manufactured with low cost and without increase of machining steps (simultaneously machining effect).

In the button according to the present invention, the protrusion preferably has a form with the width gradually becoming smaller from the inner periphery of the opening toward the center of the opening part. The form with the width gradually becoming smaller from the inner periphery of the opening toward the center of the opening includes, for instance, a tooth-like form, a triangular form, a trapezoidal form, a circular form and the like.

With the configuration as described above, the protrusions have a form with the width gradually becoming smaller from the inner periphery of the opening toward the center of the opening, so that the protrusions easily crimp into an outer peripheral surface of the shaft.

In the button according to the present invention, the opening has a polygonal form having 5 or more corners, preferably having 5 to 12 corners, and each side forming the polygon functions as the crimping section, and the shaft preferable has around cross section substantially perpendicular to the axial line of the shaft.

With the configuration as described above, when the shaft of the accommodation member is expanded outward in association with insertion of a fixture (into an insert hole of the accommodation member), each side of the polygon of the opening functions as the crimping section and crimps into the outer peripheral surface of the shaft, so that the shell member and the accommodation member can be integrated with each other. Even with this configuration, the uniformly crimping effect and simultaneously machining effect can be expected.

In the button according to the present invention, the opening has a circular form, and the shaft has a cross section substantially perpendicular to the center line thereof and having a polygonal form with 5 or more corner, preferably having 5 to 12 corners, and each side forming the polygon preferably functions as the crimping section.

With the configuration as described above, when the shaft of the accommodation member is expanded outward in association with insertion of the fixture (into an insert hole of the accommodation member), the inner periphery of the opening crimps into each corner of the polygonal cross section of the shaft, so that the shell part and the accommodation member can be integrated with each other.

In the case of this configuration, also the uniformly crimping effect can be expected. Further when the shaft is integrally molded, for instance, by molding resin, it is possible to mold a section near the protruding edge of the shaft so that a cross section thereof is polygonal, so that also the simultaneously machining effect can be expected.

In the button according to the present invention, the insert hole preferably has steps with the inner diameter thereof becoming smaller step by step from an end face opposite to the protruding end face of the shaft toward the protruding end face.

With the configuration as described above, as the insert hole has steps with the inner diameter thereof becoming smaller step by step from an end face opposite to the protruding end face of the shaft toward the protruding end face, the shaft of the accommodation member can be expanded largely in association with insertion of the fixture (into the insert hole of the accommodation member). Therefore also the crimping length becomes larger, so that the more secure integration can be expected.

In the button according to the present invention, the shaft has an accommodation portion having the substantially same diameter as the inner diameter of the neck, a protruding portion protruding from the opening and crimping into the opening, and an intermediate portion coupling the accommodation portion to the protruding portion, and preferably a clearance is provided between the intermediate portion and the neck.

With the configuration as described above, when a fixture is inserted into the insert hole of the accommodation member, the shaft of the accommodation member expands outward, but as a clearance is provided between the intermediate portion of the shaft and the neck, outward expansion of the shaft is not restricted by the neck. In addition, expansion and deformation of the neck due to the outward expansion of the shaft can be prevented. Because of the configuration, a product having an excellent appearance can be obtained.

In the button according to the present invention, a plurality of projected treads radially extending from the insert hole as the center are preferably provided on a protruding end face of the shaft with a prespecified angular space, and the fixture has an insert shaft inserted into an insert hole of the accommodation member and a flange integrally formed on and with a base end of this insert shaft, and also protrusions facing the projected treads with fabric therebetween against are preferably formed on the inner surface of the flange in the circumferential direction around the insert hole.

In a button having the ordinary structure, when a force is loaded to the button body in the rotating direction, sometimes the button body and the fixture may integrally rotate against fabric.

In the present invention, as a plurality of projected treads are radially provided on the protruding end face of the shaft and, in addition, protrusions facing against the projected treads with the fabric therebetween are provided on the inner surface of the flange of the fixture, namely as the projected treads and protrusions function as a rotation stop preventing rotation against the fabric, so that rotation of the button body together with the fixture against the fabric can be prevented without fail.

In the button according to the present invention, the shell member constituting the button body is preferably made of metal and the accommodation member is preferably formed from synthetic resin.

With the configuration as described above, the shell member constituting the button body can easily be manufactured by press machining of metal and also the accommodation member by molding synthetic resin, which ensures low cost production of the button.

Further, in the conventional buttons, as the metallic portion corresponding to the shell member and generally called body directly contacts fabric, sometimes discoloration and degradation of the fabric may occur due to the chemical phenomenon called as a potential difference. Further as the metallic portion directly contacts fabric, sometimes the fabric may be cut. To overcome the phenomena as described above, there has been proposed a type in which a resin insert corresponding to the accommodation member is provided in a protruding state, but in this case, the body and the insert may rotate against each other. The present invention can also solve these problems.

BEST MODE FOR CARRYING OUT THE INVENTION

An embodiment of the present invention is described below with reference to the related drawings.

Figure 1:
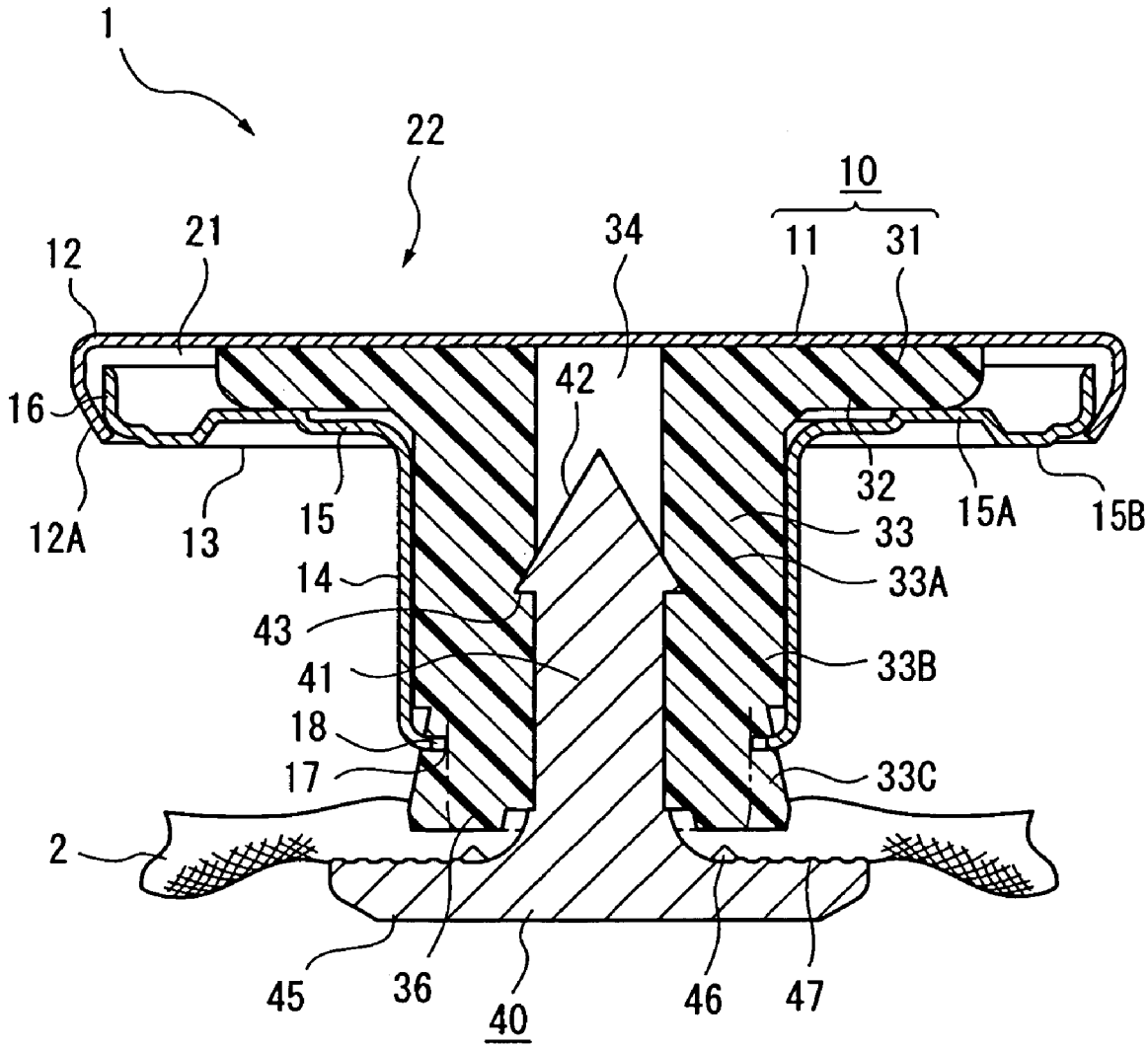
FIG. 1 is a cross-sectional view showing an assembled state of a button according to an embodiment of the present invention.
Figure 2:
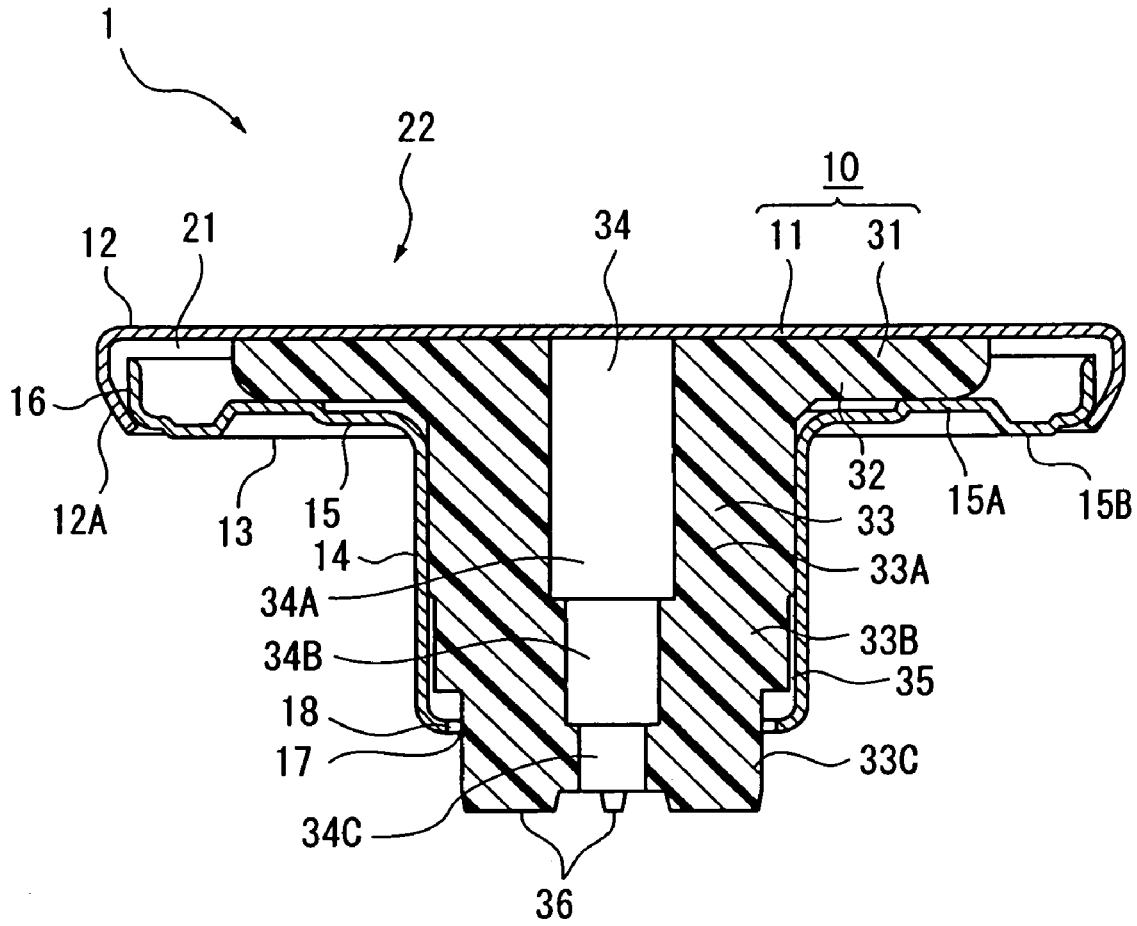
FIG. 2 is a cross-sectional view showing a state where a button body and a fixture have been removed from fabric according to the embodiment.
Figure 2:
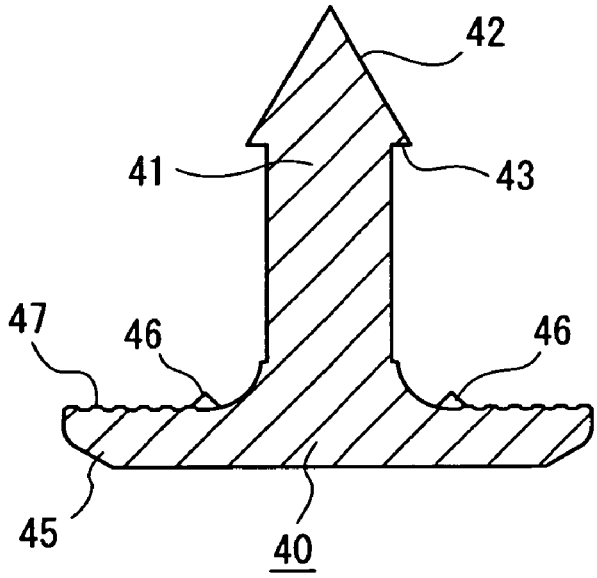

FIG. 1 is a cross-sectional view showing a case in which a button according to the present invention is applied to that for jeans, and the view shows the state in which the button is fixed on fabric, while FIG. 2 is a cross-sectional view showing each component in the state where the button for jeans according to the embodiment above has been removed from the fabric.

As shown in the figures, a button 1 for jeans according to the present embodiment includes a button body 10, and a fixture 40 for fixing the button body 10 to a fabric 2 from the opposite side to the button body 10 with the fabric of a garment therebetween.

Figure 3:
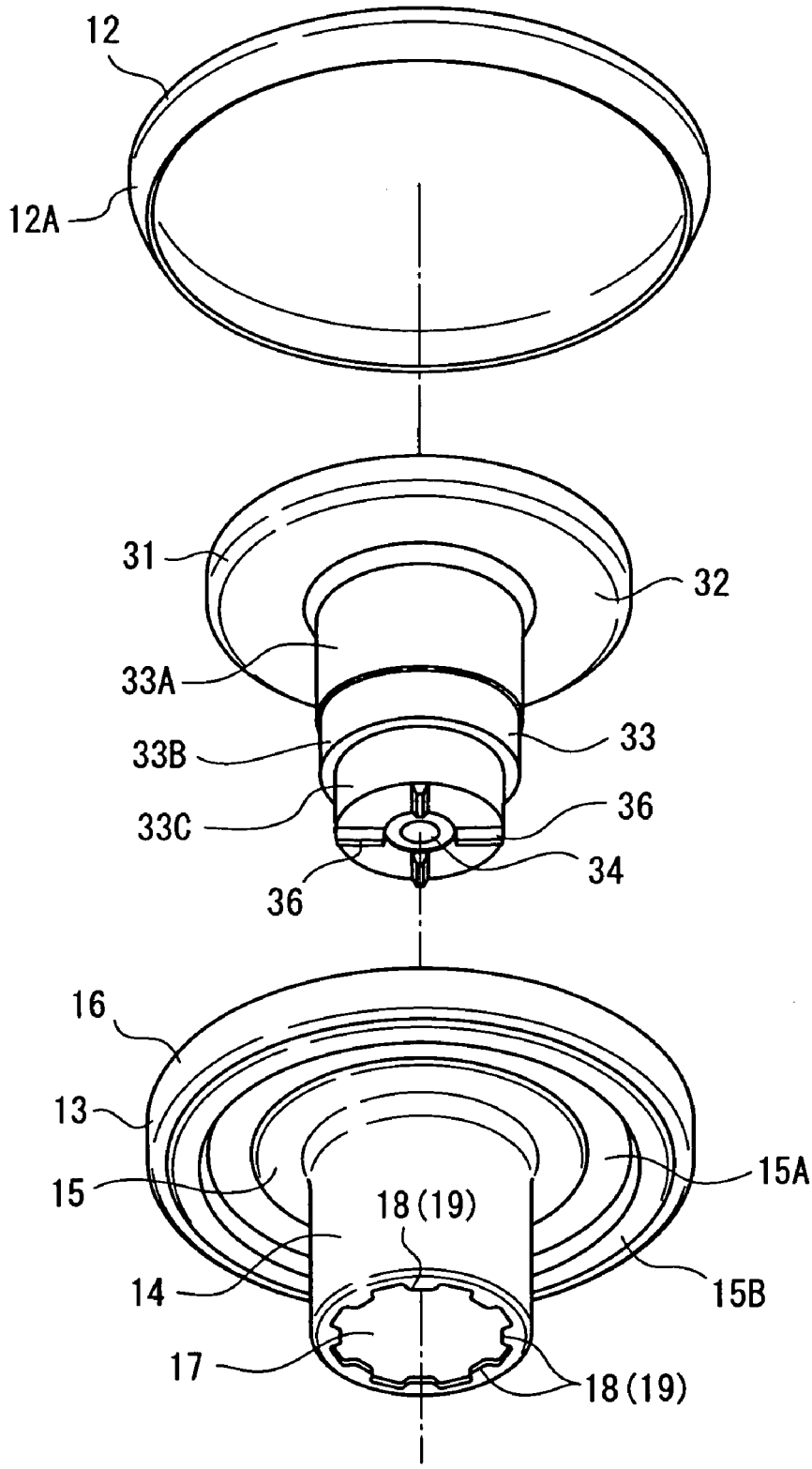
FIG. 3 is an exploded perspective view showing the button body according to the embodiment.

The button body 10 includes a shell member 11 constituting an outer shell of the button and an accommodation member 31 accommodated in the shell member 11. The shell member 11 includes, as shown in FIG. 3, a button covering material 12 formed by spinning metal and constituting a button cover 22, and a button base material 13 also formed by spinning metal.

The button base material 13 includes a neck 14 having a cylindrical form, a circular flange 15 integrally formed with the neck 14, bending from an end (upper edge in FIG. 1 and FIG. 2) of the neck 14 at right corners outward, and having a larger outer form (outer diameter) than an outer form (an outer diameter) of the neck 14, a an upright upper rim 16 integrally formed with an outer periphery of the flange 15 and bend at right corners to the opposite side from the neck 14, and an opening 17 formed on the other end of the neck 14.

Formed in a circular portion of the flange 15 are a first circular rib 15A bulged upward in FIG. 1 and a second circular rib 15B bulging downward in FIG. 1 respectively.

Crimping parts 18 crimping in the accommodation member 31 are provided with a space therebetween at a prespecified position along the circumferential direction on the inner periphery of the opening 17. The crimping parts 18 are a plurality of convex parts 19 formed with a prespecified space therebetween at a prespecified position along the inner periphery of the opening 17. Each of the convex parts 19 has a form with the width becoming gradually smaller from the inner periphery of the opening 17 toward a center of the opening 17, herein forming like gear teeth.

The button covering material 12 has a disk-like form and an outer periphery 12A thereof is engaged in and fixed to an outer periphery of the flange 15 from the outside. A space 21 is formed between the button covering material 12 and the flange 15.

The accommodation member 31 includes, as shown in FIG. 3, a collar 32 accommodated within the space 21 between the button covering material 12 and the flange 15, a shaft 33 accommodated in the neck 14 and having a round cross section perpendicular to the center line thereof, and an insert hole 34 formed on an end face protruding from the neck 14 of the shaft 33 for the fixture 40 to be inserted therein. The accommodation 31 is made of a material softer at least than that used for forming the neck 14 and also allowing to expand the external form of the shaft 33 to the outer position from the inner contour of the opening 17 when the fixture 40 is inserted into the insert hole 34 such as synthetic resin as used in this embodiment.

The collar 32 has a form like a disk with the outer diameter reaching the first circular rib 15A of the flange 15 and the width substantially equal to the space 21 between the button covering material 12 and the flange 15.

The shaft 33 has the accommodation portion 33A having the substantially same outer diameter as the inner diameter of the neck 14 of the shell member 11, a protruding portion 33C having the outer diameter smaller than the inner diameter of the opening 17 and protruding from the opening 17, and the intermediate portion 33B having the outer diameter smaller than an outer diameter of the accommodation portion 33A and larger than an outer diameter of the protruding portion 33C and coupling the accommodation portion 33A to the protruding portion 33C. An outer diameter of the intermediate portion 33B is smaller than an inner diameter of the neck 14 so that a clearance 35 is formed between the intermediate portion 33B and the neck 14.

A plurality of (four) projected treads 36 are formed on a protruding end face of the protruding portion 33C, namely on a protruding end face of the shaft 33 with a prespecified space therebetween (at an angular space of 90 degrees) each extending radially from the insert hole 34 as a center.

The insert hole 34 has a step-like form with the inner diameter becoming smaller step by step from an end face opposite to the protruding end face of the shaft 33 toward the protruding end face. In this embodiment, in the insert hole 34 including a first hole 34A, a second hole 34B with the inner diameter smaller than the first hole 34A, and a third hole 34C with the inner diameter smaller than that of the second hole 34B are arranged sequentially on the three steps as described above.

Figure 4:
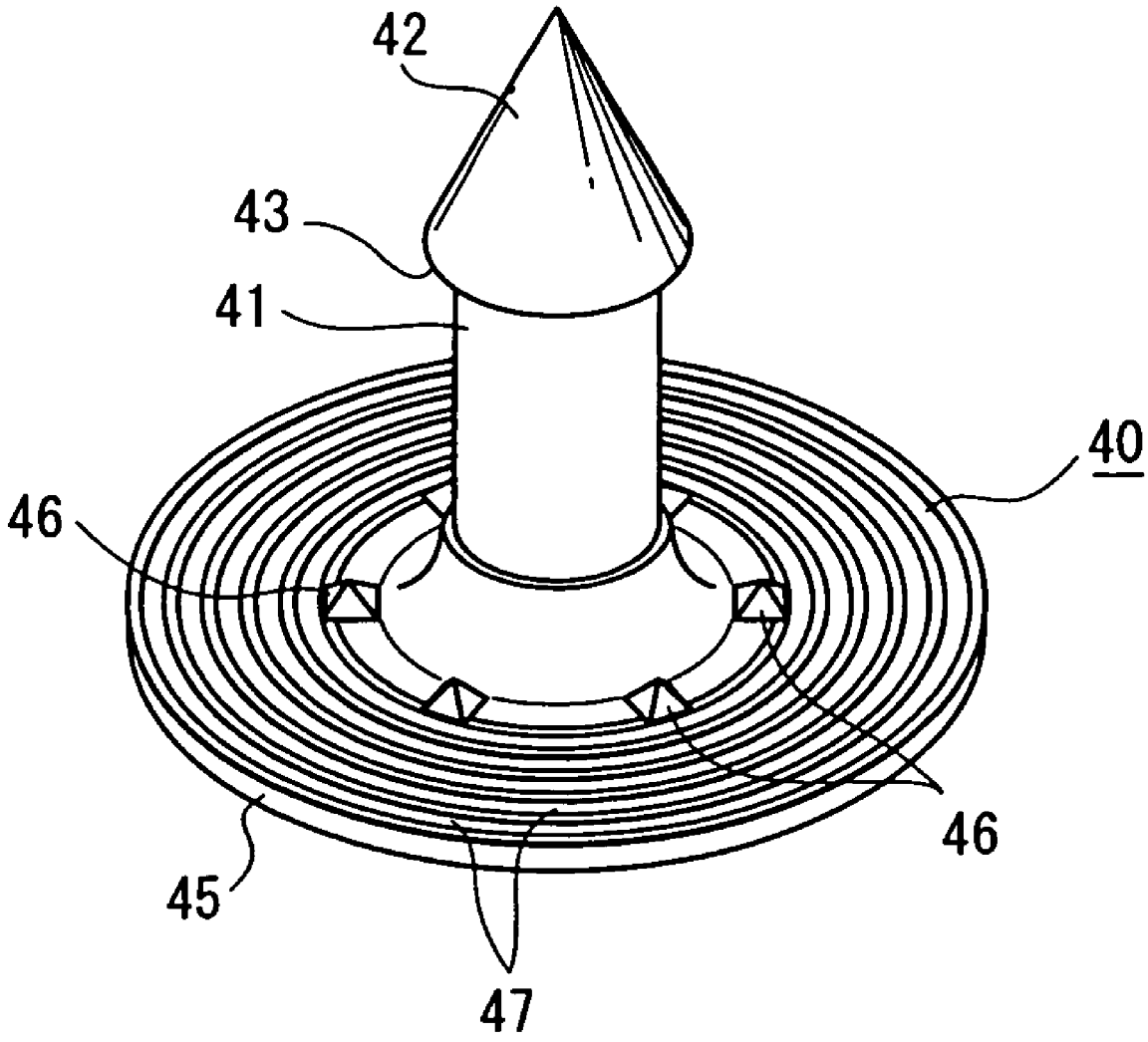
FIG. 4 is a perspective view showing a fixture according to the embodiment.

The fixture 40 includes, as shown in FIG. 4, an insert shaft 41 to be inserted into the insert hole 34 of the accommodation member 31, and a flange 45 integrally formed on a base end side of the insert shaft 41. The fixture 40 is made of metal.

The insert shaft 41 includes a guide part 42 having a conical tip and also having a round cross section perpendicular to the center line of the insert shaft 41 and an engagement 43. The insert shaft 41 has the outer diameter larger than an inner diameter of the second hole 34B of the insert hole 34, and because of the difference, the shaft 33 can expand to the outer side to crimp into the crimping part 18. For instance, when an inner diameter of the second hole 34B is 15 mm and an outer diameter of the insert shaft 41 is 21 mm, the inner diameter of the hole 34B expands by the difference, namely by 6 mm, and the shaft 33 can crimp into the crimping part 18.

Formed on an inner surface of the flange 45 are protrusions 46 each having a form like a quadrangular pyramid, opposing to the projected treads 36 of the accommodation member 31 with the fabric 2 therebetween, and provided in the circumferential direction of the flange 45 are and also ring-formed concavo-convex portions 47 provided concentrically around the insert shaft 41. With the configuration as described above, when the button body 10 is to be fixed on the fabric 2 of a garment, the fixture 40 is inserted into the insert hole 34 of the accommodation member 31 through the fabric 2 from the opposite side from the button body 10 with the fabric 2 therebetween. Then, the shaft 33 of the accommodation member 31 is expanded outward to the outer side of the inner contour of the opening 17.

In this state, the convex parts 19 are formed on the inner periphery of the opening 17 with a prespecified space at specified positions in the circumferential direction, and the convex parts 19 crimp into the shaft 33 of the accommodation member 31, namely into the protruding portions 33C, so that the shell member 11 and the accommodation member 31 are integrated with each other. In other words, relative rotation between the shell member 11 and the accommodation member 31 can be prevented without fail.

Further the fabric 2 is held between the protruding end face of the shaft 33 of the accommodation member 31 and the inner surface of the flange 45 of the fixture 40. In this state, as the plurality of projected treads 36 are radially provided on the protruding end face of the shaft 33 and further protrusions 46 facing against the projected treads 36 with the fabric 2 therebetween on the inner surface of the flange 45 of the fixture 40, namely as the projected treads 36 and the protrusions 46 function each as a rotation stop, so that relative rotation of the button body 10 and the fixture 40 against the fabric 2 can be prevented without fail.

With the present embodiment, the following advantages can be expected.

(1) As the convex parts 19 crimping into the shaft 33 (protruding portion 33C) of the accommodation member 31 are formed on the inner periphery of the opening 17 of the shell member 11, when the fixture 40 is inserted into the insert hole 34 of the accommodation member 31 through the fabric 2, as the shaft 33 of the accommodation member 31 is expanded outward, so that the convex parts 19 crimp into the shafts 330 (protruding portion 33C) of the accommodation member 31. Therefore, the shell member 11 and the accommodation member 31 can be integrated to each other. In other words, rotation of the shell member 11 as well as of the accommodation member 31 can be stopped without fail.

(2) The convex parts 19 are formed with a prespecified space therebetween at specified positions in the circumferential direction of the opening 17, and the convex parts 19 uniformly crimp into the entire periphery of the shaft 33 (protruding portion 33C), so that the shell member 11 and the accommodation member 31 can be integrated with each other more tightly (uniformly crimping effect). In addition, when the opening 17 is formed by punching in the press machining or the like, also the convex parts 19 can be formed simultaneously. Therefore, the button according to the present invention can be manufactured with low cost and without increase of machining steps (simultaneously machining effect).

(3) The convex parts 19 have a form with the width gradually becoming smaller from the inner periphery of the opening 17 toward a center of the opening 17, and the shaft 33 has a round cross-section perpendicular to the center line thereof, so that the convex parts 19 easily crimp into the outer peripheral surface of the shaft 33 (protruding portion 33C).

(4) The insert hole 34 has a stepped form with the inner diameter becoming smaller step by step from the end face opposite to the protruding end face of the shaft 33 toward the protruding end face, namely the inner diameter of the third hole 34C closest to the protruding end face of the insert hole 34 is formed to be smallest, so that a large space for expansion of the shaft 33 of the accommodation member 31 in association with insertion of the fixture 40 (into the insert hole 34 of the accommodation member 31) can be secured. Because of this configuration, the large crimping length is secured, so that more tight integration can be expected.

In addition, in the state where the fixture 40 is inserted into the insert hole 34, the engagement 43 of the fixture 40 is engaged by steps in the stepped hole of the insert hole 34, so that a force required for separating the button is large. Therefore, the button is not easily separated from the fabric 2.

(5) In addition, the insert hole 34 has three steps, and when the accommodation member 31 is molded with resin, the core for forming the insert hole provided in a die is required only to have a from becoming smaller step by step, so that the core is never broken when as a molded product is taken out, and further die cutting is advantageously easy.

(6) In the shaft 33, the outer diameter of the intermediate portion 33B for coupling the accommodation portion 33A to the protruding portion 33C is smaller than the inner diameter of the neck 14 of the button base material 13, and further the clearance 35 is provided between the intermediate portion 33B and the neck 14, so that, even when the shaft 33 of the accommodation member 31 is expanded outward in association with insertion of the fixture 40 of the accommodation member 3 into the insert hole 34, not only outward expansion of the shaft 33 is not restricted by the beck part 14, but also the possibility of expansion and deformation of the neck 14 due to outward expansion of the shaft 33 can be eliminated. Because of this feature, a product with excellent appearance can be obtained.

(7) A plurality of projected treads 36 are radially provided on the protruding end face of the shaft 33, and further the protrusions 46 facing against the projected treads 36 respectively are provided on the inner surface of the flange 45 of the fixture 40 in the circumferential direction with the fabric 2 therebetween, namely the projected treads 36 and the protrusions 46 respectively function as a rotation stop relative to the fabric 2 therebetween, so that relative rotation of the button body 10 and the fixture 40 against the fabric 2 can be prevented without fail.

(8) The shaft 33 of the accommodation member 31 protrudes from the opening 17 of the button base material 13, and the fabric 2 is held between this protruding end face and the flange 45 of the fixture 40, namely the button base material 13 made for metal does not directly contact the fabric, so that troubles caused by direct contact between a metal-made member and fabric do not occur.

Generally, when a metal-made member and fabric directly contact each other, discoloration or degradation of the fabric 2 easily occurs due to the chemical reaction called as an electric potential difference, and sometimes the fabric may be cut due to contact by the metal-made part. However, with the configuration according to this embodiment of the present invention, any of the troubles as described above does not occur.

(9) The shell member 11 constituting the button body 10, namely the button covering material 12 and button base material 13 are made of metal, and the accommodation member 31 is made of synthetic resin, and therefore the button covering material 12 and button base material 13 can easily be produced by press-machining metal, and the accommodation member 31, for instance, by injection-molding of synthetic resin, so that the production cost is low.

The present invention is not limited to a structure of a button for jeans described in the embodiment above, and also includes the modifications as described below.

In the embodiment described above, the so-called gear-teeth type of convex parts 19 are formed at specified positions with a prespecified space along the inner periphery of the opening 17, but a form of the convex parts 19 is not limited to the form like gear-teeth, and any of a triangular form, a trapezoidal form, a circular form and the like may be employed, or it does not even have to be protruded. In brief, any form allowing crimping into the accommodation member 31 may be employed.

Figure 5:
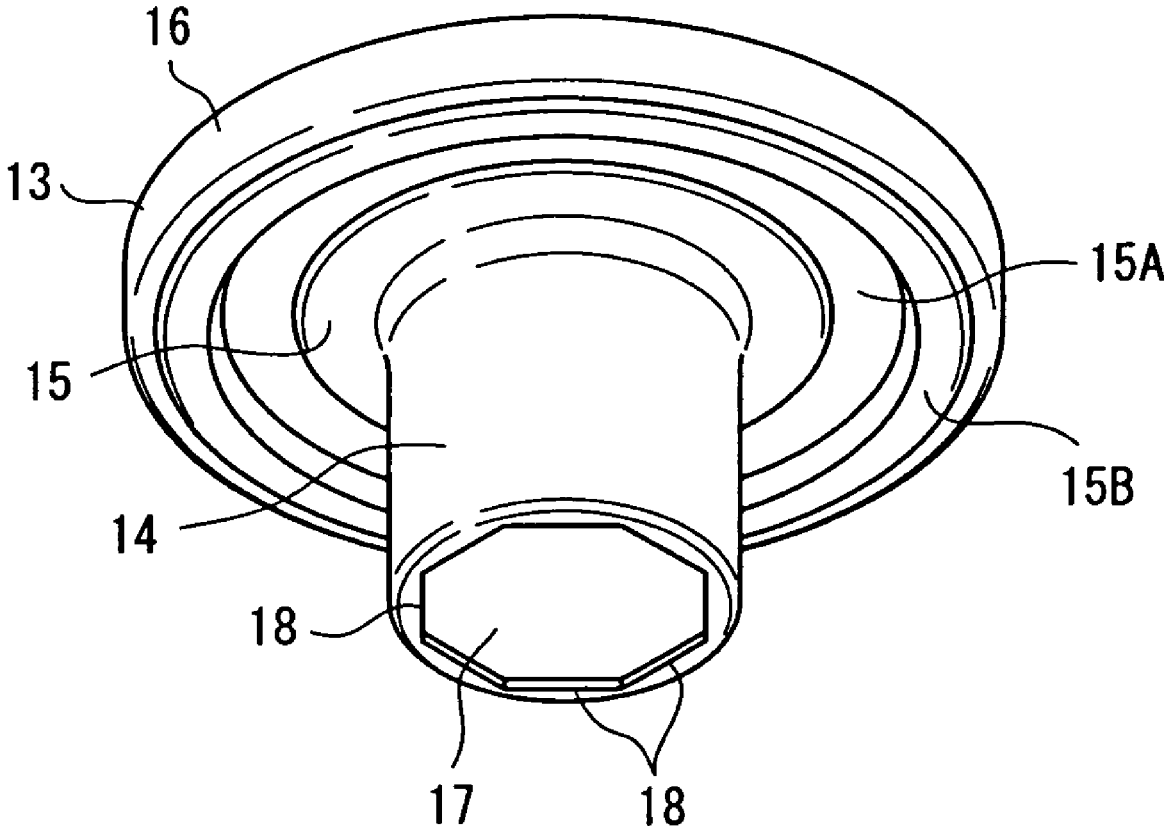
FIG. 5 is a perspective view showing a modification of a button base material constituting the button body according to the embodiment.

For instance, the opening 17 may have a polygonal form such as an octagonal one as shown in FIG. 5, and each of the sides of this polygon may be used as the crimping part 18. A number of corners in the polygon is five or more, and preferably in the range from 5 to 12. In this case, the shaft 33 (protruding portion 33C) has a round cross section perpendicular to the center line of the shaft 33.

With the configuration as described above, when the shaft 33 of the accommodation member 31 is expanded outward in association with insertion of the fixture 40 (into the insert hole 34 of the accommodation member 31), each side of the polygon of the opening 17 functions (works) as the crimping part 18 and crimps into an outer peripheral surface of the shaft 33 (protruding portion 33C), so that the shell member 11 and accommodation member 31 can be integrated with each other. Even with the configuration as described above, the uniform crimping effect and simultaneously machining effect as described in (2) can be expected.

Different from the embodiment described above, with the configuration in which the opening 17 par a round form and the shaft 33 (protruding portion 33C) may a polygonal cross section perpendicular to the center line of the shaft 33 and having five or more corners preferably in the range from 5 to 12 corners, the same effects can be achieved.

Figure 6:
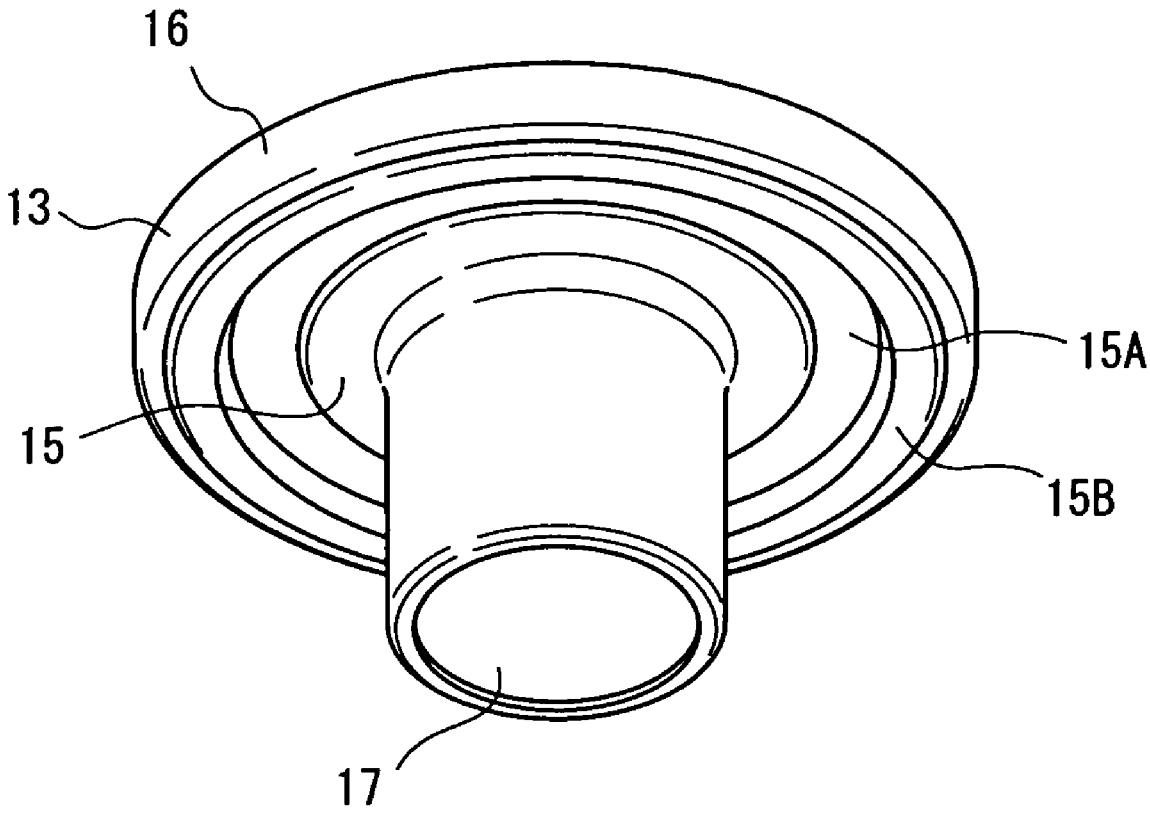
FIG. 6 is a perspective view showing another modification of the button material constituting the button body according to the embodiment.
Figure 7:
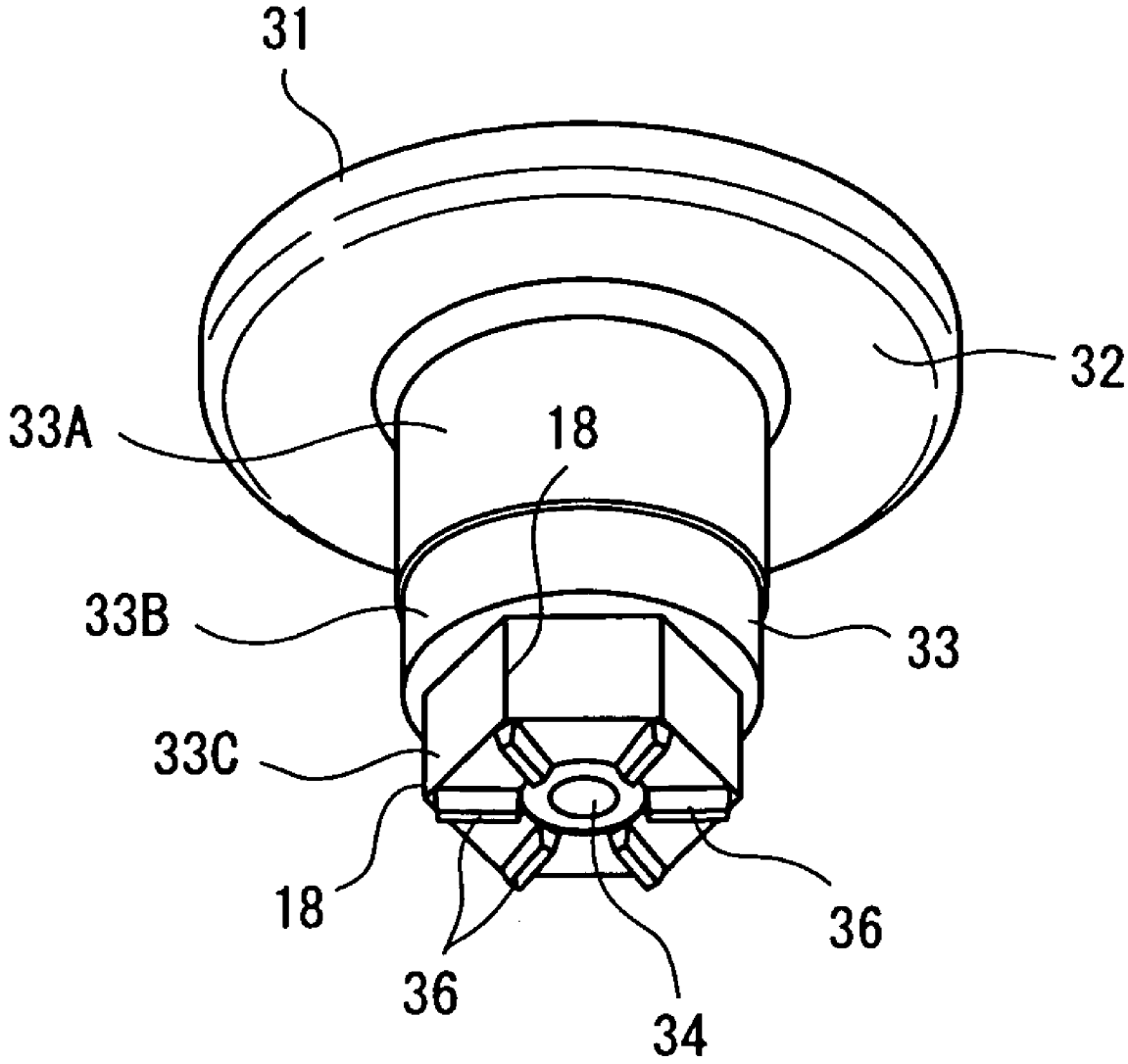
FIG. 7 is a perspective view showing a modification of an accommodation member constituting the button body according to the embodiment.
Figure 8:
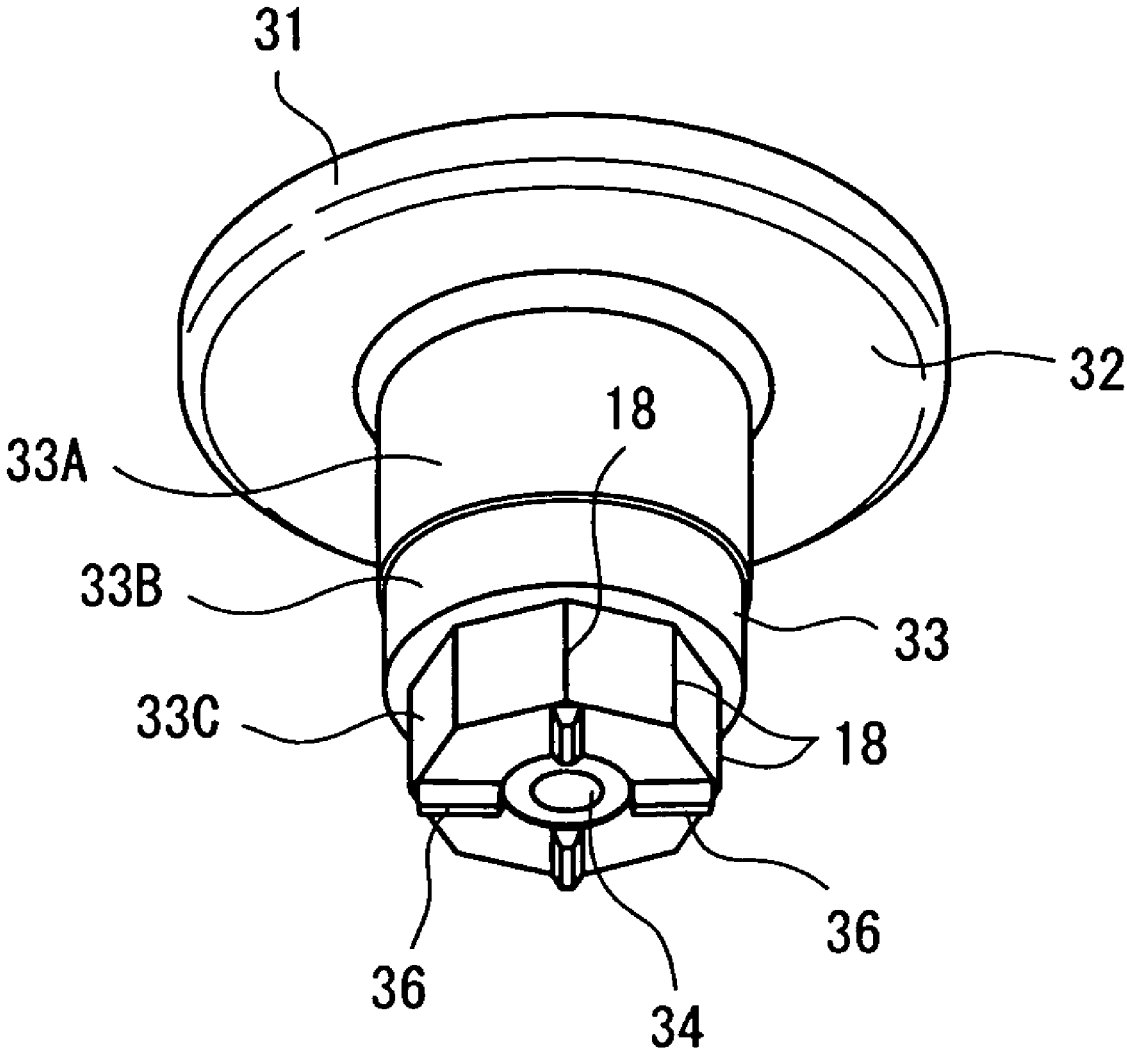
FIG. 8 is a perspective view showing another modification of the accommodation member constituting the button body according to the embodiment.
Figure 9:
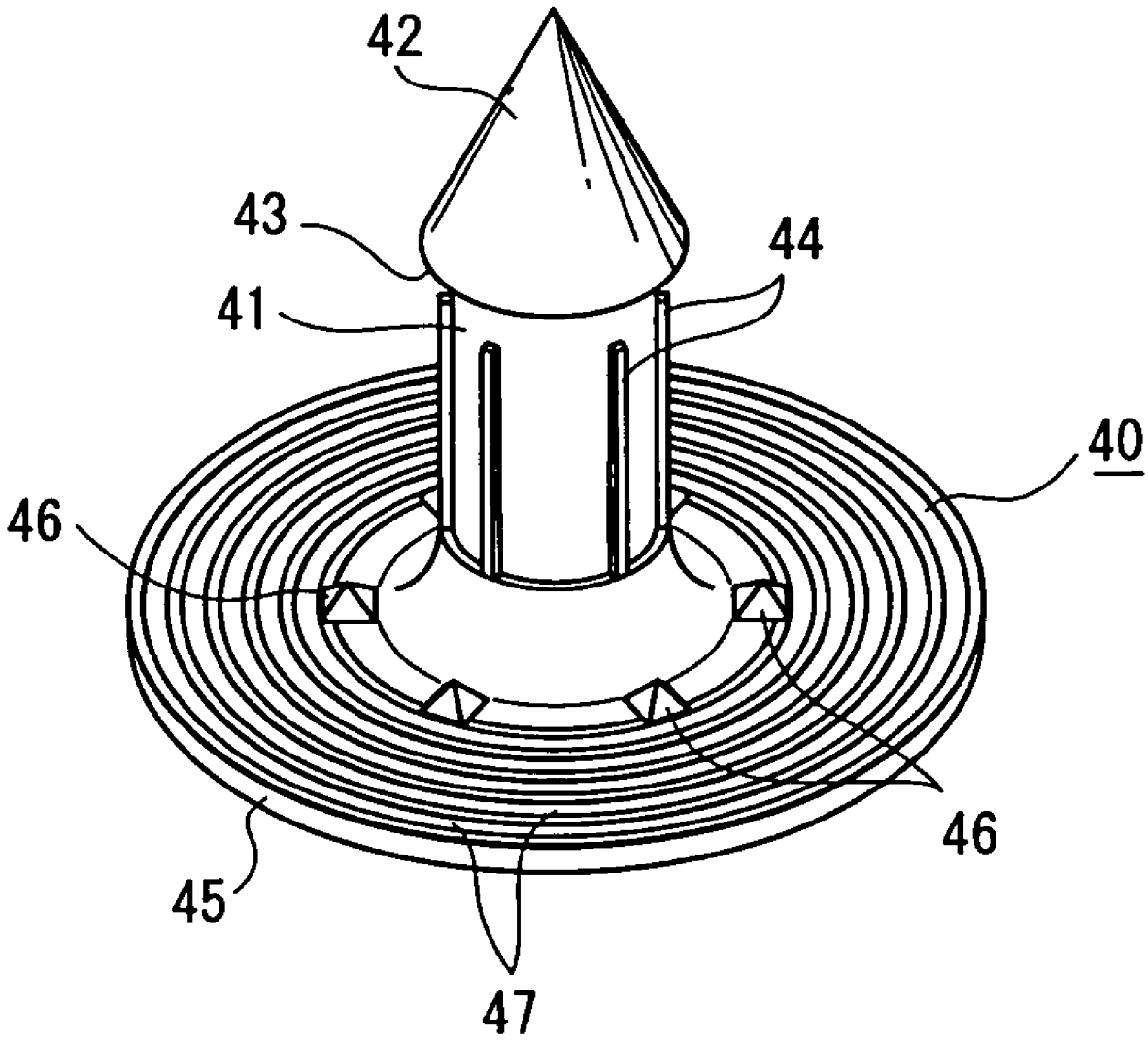
FIG. 9 is a perspective view showing a modification of a fixture according to the embodiment above.

For instance, FIG. 6 shows a case in which the opening 17 has a round form, FIG. 7 shows a case in which a cross section of the shaft 33 (protruding portion 33C) is hexagonal, and FIG. 8 shows a case in which a cross section of the shaft 33 (protruding portion 33C) is octagonal.

Even with the configuration as described above, each corner of the polygon as a cross section of the shaft 33 (protruding portion 33C) can function as the crimping part 18. In other words, when the shaft 33 of the accommodation member 31 is expanded outward in association with insertion of the fixture 40, the inner periphery of the opening 17 crimp into corners of the polygonal cross section of the shaft 33 (protruding portion 33C), so that the shell member 11 and the accommodation member 31 can be integrated with each other.

In this configuration, also the uniformly crimping effect can be expected, and in addition, when the shaft 33 is molded integrally, for instance, by molding synthetic resin, a portion near the protruding edge of the shaft 33 can be formed with a polygonal cross section, so that also the simultaneously machining effect can be expected.

In the embodiment described above, the button body 10 includes the metal-made shell member 11 and the accommodation member 31 made of synthetic resin, but any other material may be used for the accommodation member 31 on the condition that the material is softer than that used for forming the neck 14 of the shell member 11 and allows outward expansion of an external form of the shaft 33 to the outer position from the inner contour of the opening 17 when the fixture 40 is inserted into the insert hole 34.

Further the material for the fixture 40 is not limited to metal, and any other material such as, for instance, synthetic resin may be used on the condition that the material allows outward expansion of the shaft 33 of the accommodation member 31 when the fixture 40 is inserted into the insert hole 34 of the accommodation member 31.

In the embodiment described above, the shell member 11 includes the button covering material 12 and button base material 13, but these components may be configured integrally.

In the embodiment described above, the insert hole 34 is formed at the center of the accommodation member 31 and this insert hole 34 has three steps, but the number of steps may be two or four or more, and also the insert hole 34 may be a straight hole.

In the embodiment described above, the conical guide part 42 for guiding insertion and the engagement 43 are formed at a tip of the insert shaft 41 of the fixture 40, but the guide part 42 for guiding insertion and the engagement 43 may be provided as several steps along the axial direction of the insert shaft 41.

Further a plurality of projected treads 44 are provided on the outer peripheral surface of the insert shaft 41 with a specified space therebetween along the axial direction. With the configuration, the projected treads 44 crimp into the insert hole 34 of the accommodation member 31, so that the function for stopping rotation of the accommodation member 31 and the fixture 40 can further be improved.

In the embodiment described above, a button for jeans is described, but the button according to the present invention is not limited to that for jeans, and can be used for other types of garments or for other than garments.

INDUSTRIAL AVAILABILITY

The present invention is applicable to buttons used for garments such as jeans and for other applications.

The invention claimed is:

1. A button comprising: a button body; and a fixture for fixing the button body to a fabric from the opposite side to the button body with the fabric there between, wherein the button body comprises a shell member constituting an outer shell of the button and an accommodation member stored in the shell member, the shell member includes a button cover and a neck cylindrically formed on a back side of the button cover and having an opening at an outer edge thereof, the accommodation member includes a shaft accommodated in the neck with a portion thereof protruding from the opening and an insert hole formed on a protruding end face of this shaft for the fixture to be inserted therein, the accommodation member being made of a material softer at least than that used for forming the neck and allowing for outer expansion of an external form of the shaft to a position outer from the inner contour of the opening when the fixture is inserted into the insert hole, crimping parts are formed on an inner periphery of the opening at specified positions with a prespecified space therebetween in the circumferential direction so as to crimp into an outer peripheral surface of the shaft, and the crimping parts are a plurality of convex parts formed at prespecified positions with a prespecified space therebetween along the inner periphery of the opening.

2. The button according to claim 1, wherein the shaft has a round cross section substantially perpendicular to the center line of the shaft.

3. The button according to claim 1 or claim 2, wherein the convex parts each has a form with the width gradually becoming smaller from the inner periphery of the opening toward the center of the opening.

4. The button according to claim 1 or 2, wherein the insert hole has steps with the inner diameter thereof becoming smaller step by step from an end face opposite to the protruding end face of the shaft toward the protruding end face.

5. The button according to claim 1 or 2, wherein the shaft has an accommodation portion having the substantially same inner diameter as that of the neck, a protruding portion protruding from the opening and also crimping into the opening, and an intermediate portion coupling the accommodation portion to the protruding portion, and a clearance is provided between the intermediate portion and the neck.

6. The button according to claim 1 or 2, wherein a plurality of projected treads are radially provided on the protruding end face of the shaft around the inert hole at with a prespecified angular space, and the fixture comprises an insert shaft inset-ted into the insert hole of the accommodation member, and a flange integrally formed on a base end of this insert shaft, and further protrusions facing against the projected threads with the fabric therebetween are formed on the inner surface of the flange in the circumferential direction around the insert hole as a center.

7. The button according to claim 1 or 2;

wherein the shell member constituting the button body is made of metal, and the accommodation member is made of synthetic resin.

* * * * *